US008333020B1

(12) United States Patent
Sanchez

(10) Patent No.: US 8,333,020 B1
(45) Date of Patent: Dec. 18, 2012

(54) SHOE WITH RETRACTABLE FIN

(76) Inventor: Abelardo Sanchez, Miami, FL (US)

( * ) Notice: Subject to any disclaimer, the term of this patent is extended or adjusted under 35 U.S.C. 154(b) by 549 days.

(21) Appl. No.: 12/615,781

(22) Filed: Nov. 10, 2009

(51) Int. Cl.
*A43B 5/08* (2006.01)
*A43B 3/24* (2006.01)

(52) U.S. Cl. ..... 36/8.1; 36/100; 36/136; 441/64

(58) Field of Classification Search ..... 36/8.1, 36/100, 136; 441/64, 61, 62, 63
See application file for complete search history.

(56) References Cited

U.S. PATENT DOCUMENTS 2,980,926 A * 4/1961 Wolshin ..... 441/64
4,599,071 A * 7/1986 Juang ..... 441/64
7,159,336 B2 * 1/2007 Burns et al. ..... 36/8.1
7,658,659 B1 * 2/2010 Fraser et al. ..... 441/64
7,736,208 B2 * 6/2010 Bonis et al. ..... 441/64
7,828,615 B2 * 11/2010 Bonis et al. ..... 441/61

* cited by examiner

*Primary Examiner* — Ted Kavanaugh
(74) *Attorney, Agent, or Firm* — Sanchelima & Associates, P.A.

(57) ABSTRACT

A shoe assembly with a retractable fin assembly that moves between two extreme positions. One of the positions is the retracted position with the fin assembly housed within a longitudinally and transversely extending cavity along the shoe's sole. The other extreme position for the fin assembly being distended outside the sole for maximum propulsion use in a body of water. Resilient support members are mounted to the lateral sides of connecting flexible web portions. A releasable fastening mechanism with a stopper for the smallest support member causes the web portions to stay taut.

5 Claims, 6 Drawing Sheets

SHOE WITH RETRACTABLE FIN

BACKGROUND OF THE INVENTION

1. Field of the Invention

The present invention relates to a shoe with a collapsible or retractable fin, and more particularly, to a shoe with a retractable fin that provides protection and support for walking, in addition to propulsion for water sports and swimming.

2. Description of the Related Art

Several designs for fins have been designed in the past. None of them, however, includes a collapsible or retractable fin or web incorporated to a shoe. The use of fins is quite desirable when a user wants to move in a body of water. However, when a user walks outside the water with fins their resistance is an undesirable obstacle and they can even be dangerous to walk with. The present invention solves this problem. It permits a user to use the invention substantially as regular shoes for walking outside the body of water and, when desired, the collapsible fins are deployed for swimming with fins. This is particularly useful in beaches where it is not uncommon to find rocks, broken glass and other objects. A user can be protected with the present invention while walking on the beach and deploy the fins when in a body of water.

SUMMARY OF THE INVENTION

It is one of the main objects of the present invention to provide a shoe that includes a collapsible or retractable fin that is helpful to propel a user in a body of water.

It is still another object of the present invention to provide such a shoe that, when retracted has, minimum interference with a user's normal walking/running activities.

It is yet another object of this invention to provide such a shoe that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
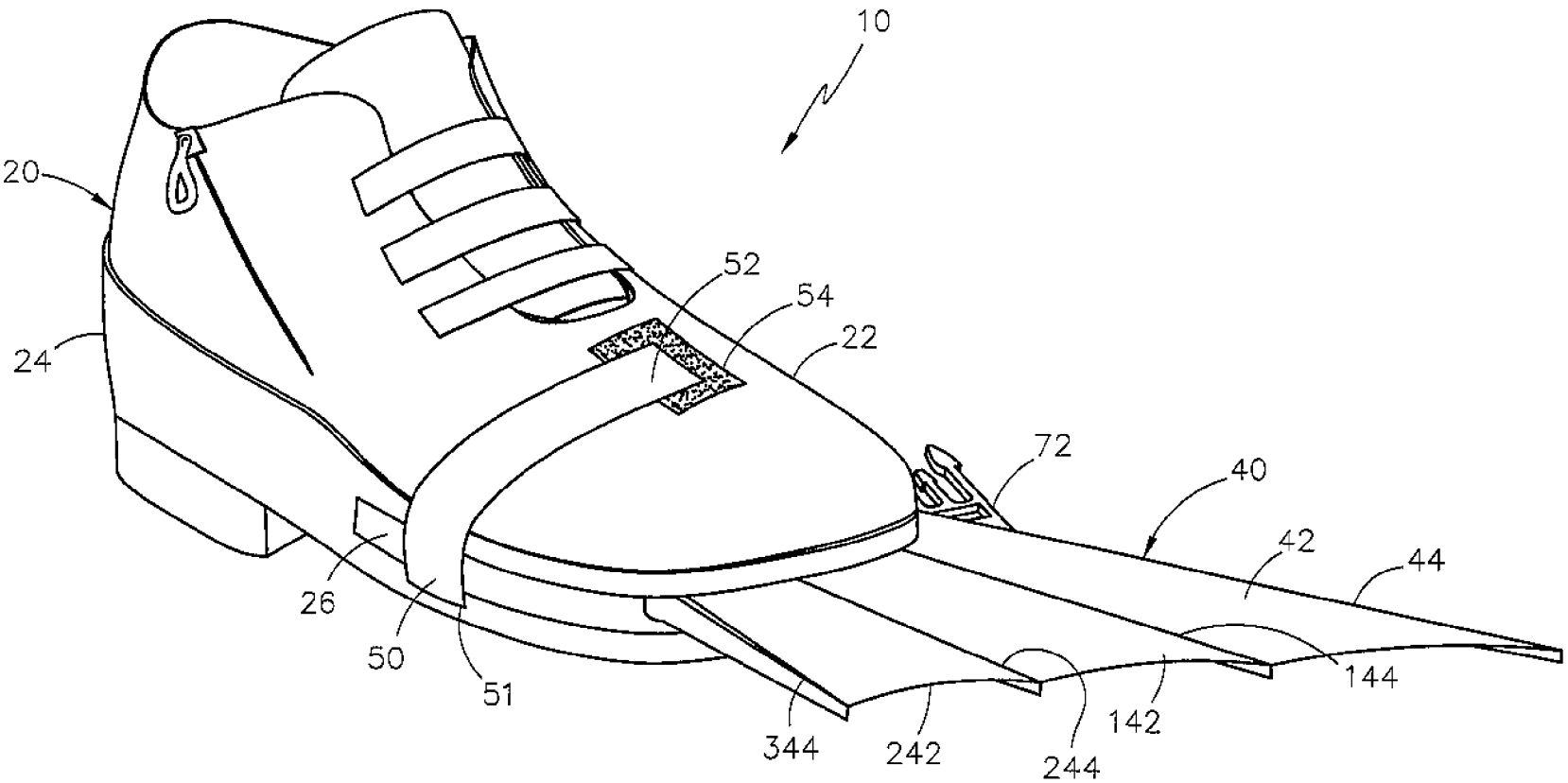
FIG. 1 represents an isometric view of a shoe with the fin deployed.

Referring now to the drawings, where the present invention is generally referred to with numeral 10, it can be observed that it basically includes shoe member 20 that may resemble a conventional shoe, and fin assembly 40, which is collapsible within cavity 26 in sole assembly 24 of member 20. The shoe assembly 10 is preferably made out of a water repellant material and/or a quick-drying material such as rubber, plastic, treated sloth and/or a combination of these materials. Another desirable characteristic of the shoe assembly 10 is that it is lightweight, yet has sufficient protection for a user's foot.

Figure 2:
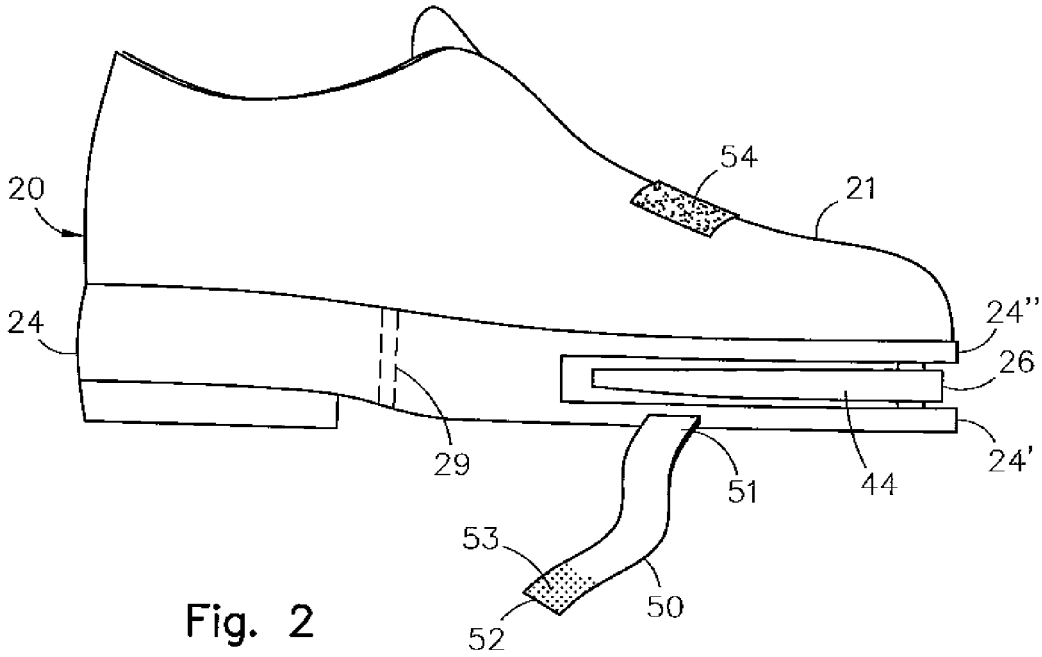
FIG. 2 illustrates a side elevational view of the shoe represented in the previous figure with the fin in the retracted position.
Figure 3A:
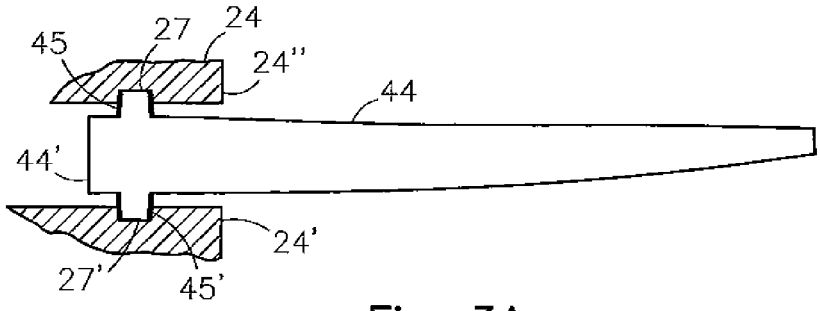
FIG. 3A is an elevational view of support member 44 with a partial cross-section of the front end 23 of sole 24 with lower portion 24' and upper portion 24" extending at a parallel and spaced apart relationship.

Shoe member 20 is comprised of upper 21 and sole assembly 24. Sole assembly 24 has cavity 26, which selectably houses fin assembly 40, as best seen in FIG. 2. Cavity 26 extends from front end 23 towards the back of assembly 24 along the outer side of shoe 20. Cavity 26 has cooperative dimensions to house members 44; 144; 244; and 344 with connecting web portions 42. In FIG. 3A, a partial cross-section of sole 24 shows lower portion 24' and upper portion 24" kept at a parallel and spaced apart relationship. Inner end 44' of support member 44 is housed within cavity 26.

Figure 3:
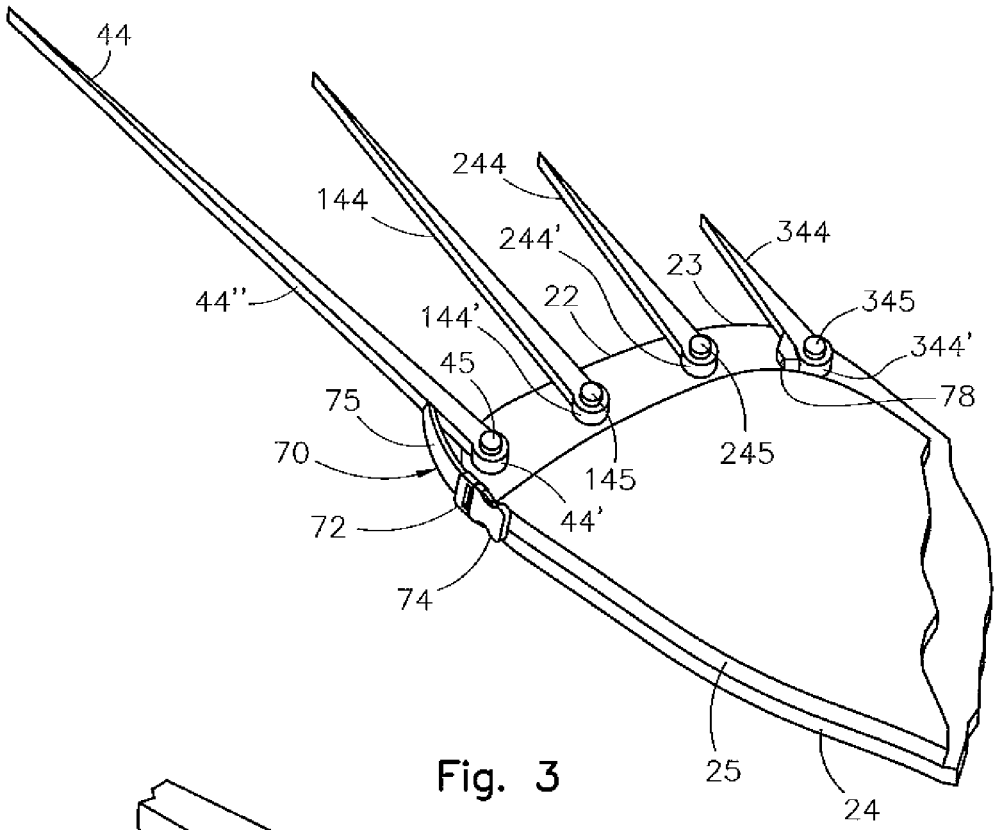
FIG. 3 shows an isometric view of the resilient support members 44; 144; 244; and 344 used in one of the embodiments pivotally mounted to the upper surface 22 of sole's 24 lower portion 24' at locations that are in a cooperatively spaced apart relationship from the front edge of the shoe sole.
Figure 3B:
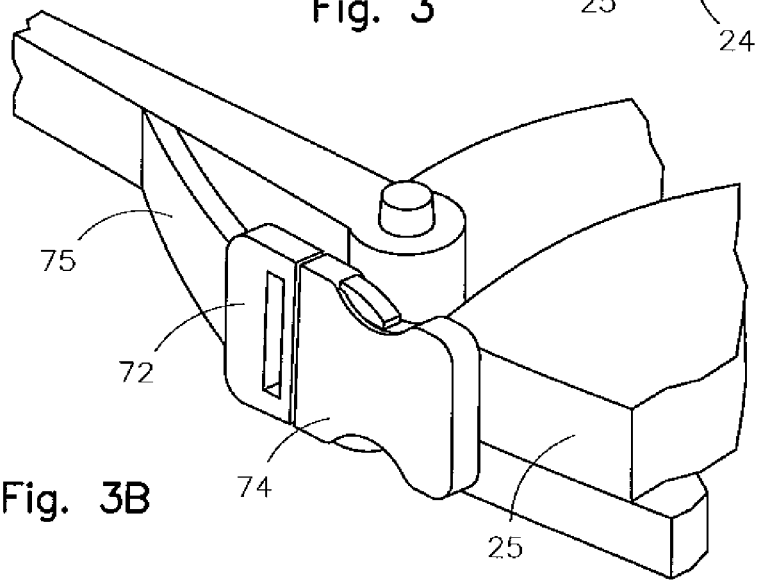
FIG. 3B is an enlarged view of buckle assembly 70, showing male portion 72 engaged with female portion 74, which in turn is mounted to partially shown spacer 25.
Figure 4:
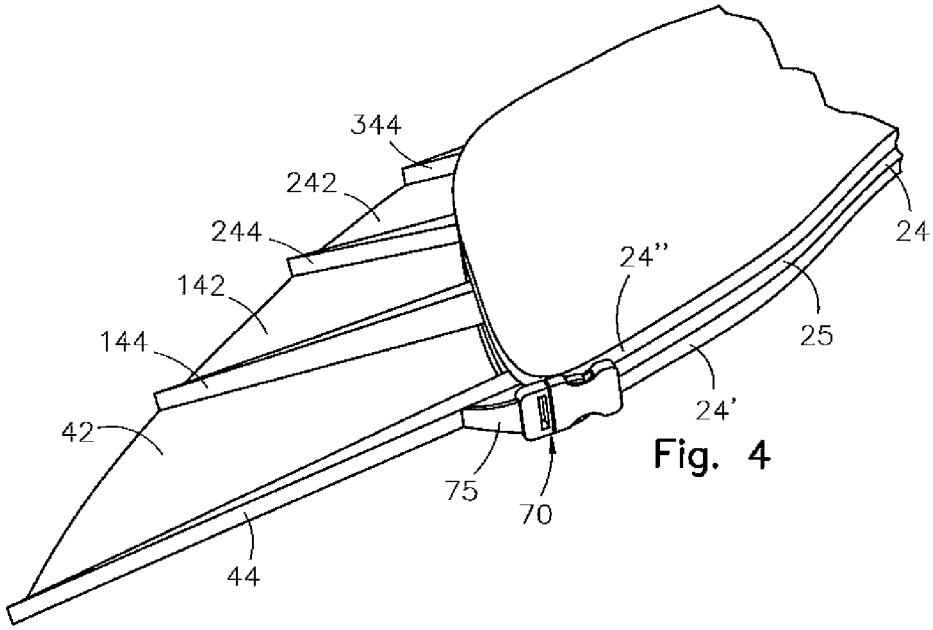
FIG. 4 is an isometric view of an embodiment of a shoe with resilient support members 44; 144; 244; and 344 that are deployed and brought in taut condition with engaged buckle assembly 70.

Fin assembly 40 includes web portions 42; 142; and 242, which extend radially out from front end 23 of sole assembly 24. Portions 42; 142; and 242 are folded and brought against each other when fin assembly 40 is collapsed and placed within cavity 26, as seen in FIG. 2. Between abutting web portions 42; 142; and 242, and at least coextensive therewith, resilient support members 44; 144; 244; and 344 connect the former to provide the necessary structural integrity to fin assembly 40. Web portions 42; 142; and 242 are made out of a flexible sheet material, such as plastic, or a similar water-resistant material. As seen in FIG. 3, one of the embodiments shows resilient elongate support members 44; 144; 244; and 344 being thinner at their distal ends. These support members have cooperative dimensions to fit inside cavity 26. Support members 44; 144; 244; and 344, have adequate flexibility and resilient characteristics to be completely foldable within cavity 26 in one extreme retracted position and selectively brought back to their deployed configuration once they are pulled out, thereby stretching the membrane or web portions 42; 142; and 242 that connect to them.

Figure 5:
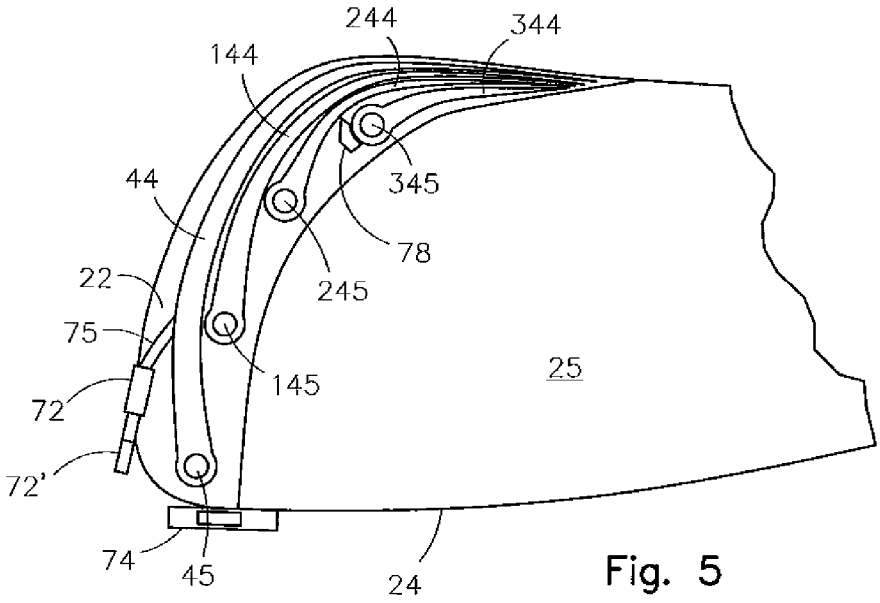
FIG. 5 shows a top view of a portion of the upperside of the sole showing the support members 44; 144; 244; and 344 retracted without the web.
Figure 6:
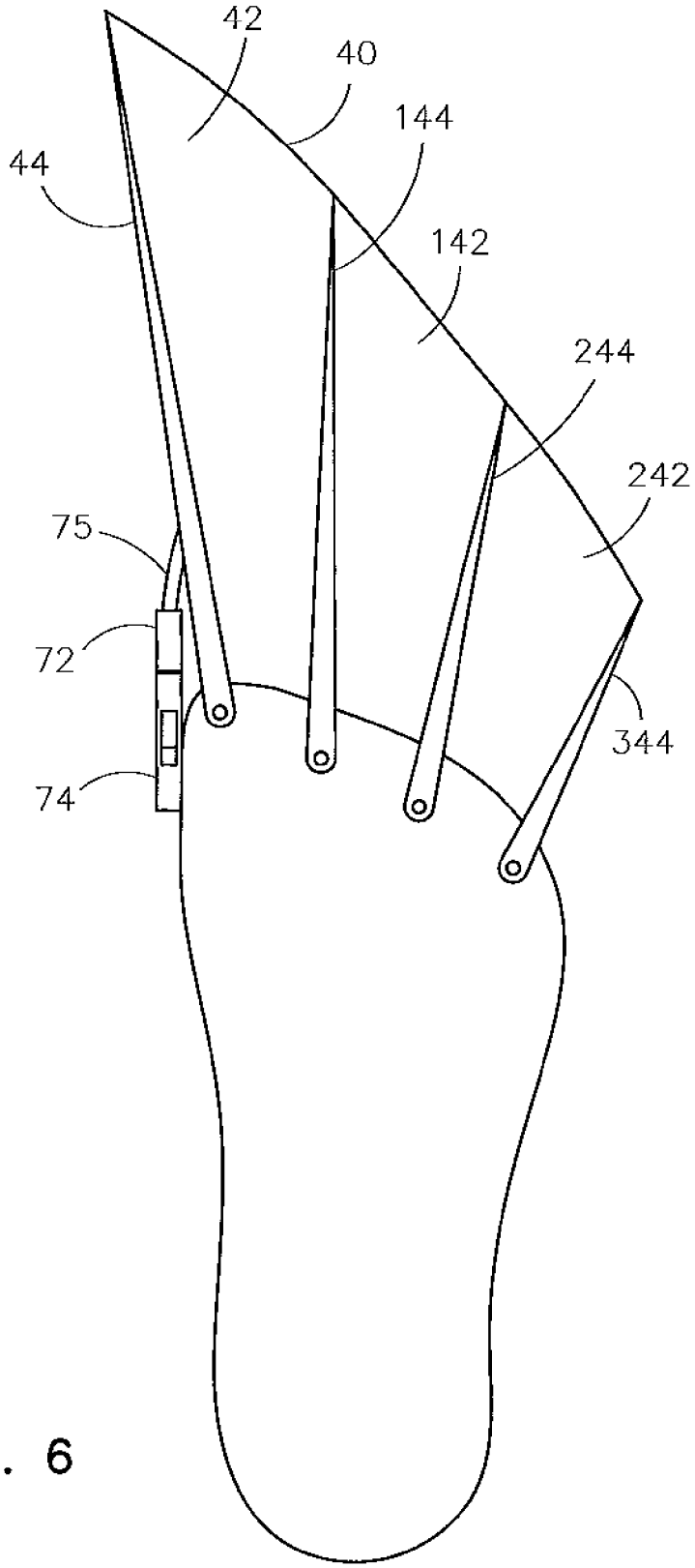
FIG. 6 represents a top view of the lower portion 24' with the support members in taut condition.
Figure 7A:
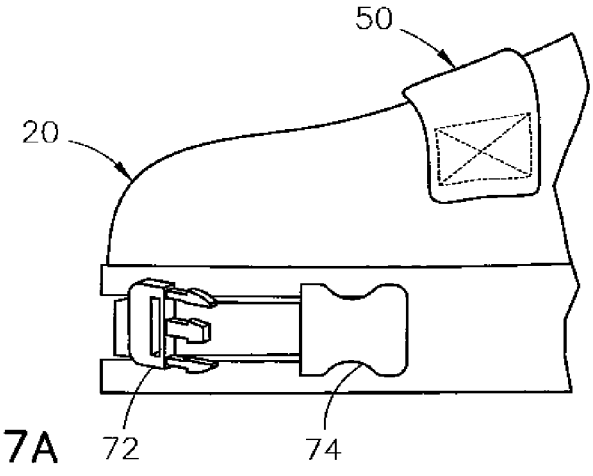
FIG. 7A is a side elevational view of the front portion of the shoe assembly with the buckle assembly unengaged and the fins in the retracted position.
Figure 7B:
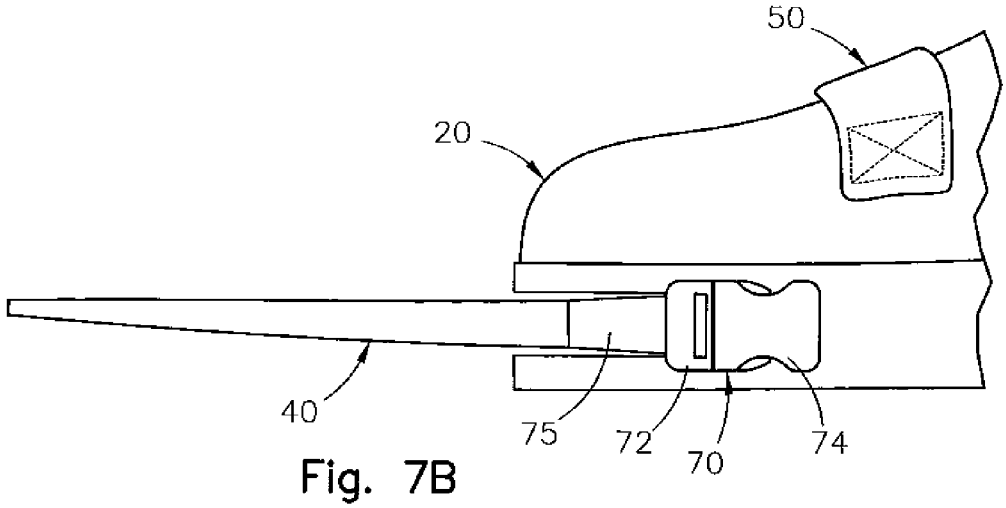
FIG. 7B is a side elevational view of the front portion of the shoe assembly with the buckle assembly engaged and the fins deployed.

Support members 44; 144; 244; and 344 have an elongate shape and, in one of the embodiments, include ends 44'; 144'; 244'; and 344' that include transversal pins 45; 145; 245; and 345, as best seen in FIGS. 3 and 3A. In FIG. 3A, the pivotal engagement of support member 44 is shown wherein transversal pin 45 extends downwardly as shown with numeral 45' and is pivotally lodged, at least partially, within bores 27 and 27'. Members 144; 244; and 344 have similar engagements with sole 24 as seen in FIGS. 3 and 5.

Support member 44 is positioned on the outermost and innermost portion of sole member 24 and it is longer than members 144; 244; and 344.

Buckle assembly 70 includes a male portion 72 and a female portion 74. Male portion 72 is mounted to the outer side 44" of support member 44 through strap 75 at a cooperative location to permit its engagement to female portion 74 when member 44 is brought to the extreme deployment position. At the deployment position, band or strap 75 is tense. Female portion 74 is mounted to the inner side of spacer 25 to permit its removable engagement with male portion 72, and specifically engaging member 72'. When portions 72 and 74 are engaged, as seen in FIG. 3, web portions 42; 142; and 242 are taut because member 344 is stopped by stopper 78 cooperatively mounted at a predetermined location on the upper surface 22 of sole 24. Female portion 74 also acts as a stopper for member 44, preventing the latter from going beyond a predetermined position.

Fin assembly 40 is selectively housed within cavity 26, which extends from front end 23 towards the rear of sole member 24, as seen in FIG. 1. Portions 42; 142; and 242 collapse inside cavity 26 and are stored completely inside in one extreme position, as shown in FIG. 2. In the other extreme position, slats 42 are completely outside cavity 26, as seen in FIG. 1.

Strap 50 has one end 51 rigidly mounted to sole 24 at a location below cavity 26. The other end 52 includes a fastening member 53 that cooperates with mating fastening member 54 at a location on sole 24 that is above cavity 26. Fastening members 53 and 54 can be implemented with Velcro or a snap button assembly or equivalent fastening components. The function of strap 50 is to keep resilient support member 44, along with members 144; 244; and 344, within cavity 26.

Sole member 24 can be optionally provided with drain ports 29 to permit the water to go through. This is useful to eliminate extra weight and to keep shoe 10 as dry as possible.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A shoe assembly, comprising:

A) a shoe member having an upper and a sole, said sole including front and rear ends, inner and outer sides, and a longitudinal cavity extending along the front end of said shoe member and said cavity extending continuously a predetermined distance towards said rear end, said cavity further defining upper and lower portions of said sole and said lower portion including an upper surface;

B) a fin assembly including at least two elongate resilient support members with first and second ends, said first ends being pivotally mounted to said sole at cooperative positions within said cavity and one of said support members being the closest to said inner side and having sufficient length to be brought in sufficient abutting relationship with the other support member or members to cause the latter to come within and stay within said cavity upon the exercise of a force of a predetermined magnitude to pivot and bend said support members and being movable between a retracted and a deployed position, said retracted position having said fin assembly completely housed within said cavity, and the other extreme position having said fin assembly deployed substantially outside said cavity and further including at least one web portion connecting said at least two elongate support members;

C) means for selectively keeping said fin assembly in said deployed position; and D) means for selectively keeping said fin assembly in said retracted position.

2. The shoe assembly set forth in claim 1 wherein said fin assembly includes at least three resilient elongate support members, said first ends being pivotally mounted to said upper surface at cooperative locations that are spaced apart from said front end a predetermined distance, and said at least three support members and corresponding web portions being selectively stored within said cavity in said retracted position.

3. The shoe assembly set forth in claim 2 wherein said means for selectively keeping said fin assembly in said retracted position includes a strap with two ends, one of said ends being mounted to said sole's outer side below said cavity and the other end being removably attached to a location on said upper above said cavity so that said support members and web portions can be selectively kept inside said cavity.

4. The shoe assembly set forth in claim 3 further including a stopper mounted to said upper surface said adjacent to said support member that is the closest to said outer side to prevent its rotation beyond a certain position thereby coacting with the other support members and said means for selectively keeping said fin assembly in said deployed position so that said web portions are kept taut.

5. The shoe assembly set forth in claim 4 wherein said means for selectively keeping said fin assembly in said deployed position includes a buckle assembly having male and female portions that releasably mate with each other, said female portion being mounted at a cooperative location on said inner side of said sole, adjacent to said spacer, said male portion being mounted to said outer side of said support member.

* * * * *